US006487853B1

(12) United States Patent
Hepburn et al.

(10) Patent No.: US 6,487,853 B1
(45) Date of Patent: Dec. 3, 2002

(54) METHOD AND SYSTEM FOR REDUCING LEAN-BURN VEHICLE EMISSIONS USING A DOWNSTREAM REDUCTANT SENSOR

(75) Inventors: Jeffrey Scott Hepburn, Birmingham, MI (US); JoAnne Temple, Canton, MI (US); Mark Allen Dearth, Dearborn, MI (US)

(73) Assignee: Ford Global Technologies. Inc., Dearborn, MI (US)

( * ) Notice: Subject to any disclaimer, the term of this patent is extended or adjusted under 35 U.S.C. 154(b) by 35 days.

(21) Appl. No.: 09/884,760

(22) Filed: Jun. 19, 2001

(51) Int. Cl.[7] ..... F01N 3/00

(52) U.S. Cl. ..... 60/295; 60/274; 60/285; 60/297

(58) Field of Search ..... 60/274, 277, 285, 60/295, 297, 301, 286, 276

(56) References Cited

U.S. PATENT DOCUMENTS 3,696,618 A 10/1972 Boyd et al.
3,969,932 A 7/1976 Rieger et al.

(List continued on next page.)

FOREIGN PATENT DOCUMENTS

DE 196 07 151 C1 7/1997
EP 0 351 197 A2 1/1990

(List continued on next page.)

OTHER PUBLICATIONS

C. D. De Boer et al., "Engineered Control Strategies for Improved Catalytic Control of $NO_x$ in Lean Burn Applications," SAE Technical Paper No. 881595, Oct. 10–13, 1988.

Y. Kaneko et al., "Effect of Air–Fuel Ratio Modulation on Conversion Efficiency of Three–Way Catalysts," SAE Technical Paper No. 780607, Jun. 5–9, 1978, pp. 119–127.

W. H. Holl, "Air–Fuel Control to Reduce Emissions I. Engine–Emissions Relationships," SAE Technical Paper No. 800051, Feb. 25–29, 1980.

A. H. Meitzler, "Application of Exhaust–Gas–Oxygen Sensors to the Study of Storage Effects in Automotive Three-Way Catalysts," SAE Technical Paper No. 800019, Feb. 25–29, 1980.

J. Theis et al., "An Air/Fuel Algorithm to Improve the $NO_x$ Conversion of Copper–Based Catalysts," SAE Technical Paper No. 922251, Oct. 19–22, 1992.

W. Wang, "Air–Fuel Control to Reduce Emissions, II. Engine–Catalyst Characterization Under Cyclic Conditions," SAE Technical Paper No. 800052, Feb. 25–29, 1980.

T. Yamamoto et al., "Dynamic Behavior Analysis of Three Way Catalytic Reaction," JSAE 882072–882166.

*Primary Examiner*—Thomas Denion
*Assistant Examiner*—Binh Tran
(74) *Attorney, Agent, or Firm*—Julia Voutyras; Allan J. Lippa

(57) ABSTRACT

A method and system for controlling the operation of a lean-burn engine whose exhaust gas is directed through an emission control device and a downstream reductant-concentration sensor, wherein a stored value for the device's instantaneous capacity to store a selected exhaust gas constituent, such as $NO_x$, is periodically adaptively updated when the sensor's output signal falls outside a predetermined range during a device purge event. A device purge event is scheduled when an accumulated measure of instantaneous feedgas $NO_x$ concentration during lean engine operation exceeds the stored $NO_x$-storage capacity value. The purge event is discontinued when the sensor's output signal exceeds the upper limit of the predetermined range, or when a determined value representing a cumulative amount of excess fuel supplied to the engine during the purge event exceeds a threshold value calculated based upon previous values for stored $NO_x$ and stored oxygen.

22 Claims, 4 Drawing Sheets

U.S. PATENT DOCUMENTS

| | | | | |
|---|---|---|---|---|
| 4,033,122 | A | | 7/1977 | Masaki et al. |
| 4,036,014 | A | | 7/1977 | Ariga |
| 4,167,924 | A | | 9/1979 | Carlson et al. |
| 4,178,883 | A | | 12/1979 | Herth |
| 4,186,296 | A | | 1/1980 | Crump, Jr. |
| 4,251,989 | A | | 2/1981 | Norimatsu et al. |
| 4,533,900 | A | | 8/1985 | Muhlberger et al. |
| 4,622,809 | A | | 11/1986 | Abthoff et al. |
| 4,677,955 | A | | 7/1987 | Takao |
| 4,854,123 | A | | 8/1989 | Inoue et al. |
| 4,884,066 | A | | 11/1989 | Miyata et al. |
| 4,913,122 | A | | 4/1990 | Uchida et al. |
| 4,964,272 | A | | 10/1990 | Kayanuma |
| 5,009,210 | A | | 4/1991 | Nakagawa et al. |
| 5,088,281 | A | | 2/1992 | Izutani et al. |
| 5,097,700 | A | | 3/1992 | Nakane |
| 5,165,230 | A | | 11/1992 | Kayanuma et al. |
| 5,174,111 | A | | 12/1992 | Nomura et al. |
| 5,189,876 | A | | 3/1993 | Hirota et al. |
| 5,201,802 | A | | 4/1993 | Hirota et al. |
| 5,209,061 | A | | 5/1993 | Takeshima |
| 5,222,471 | A | | 6/1993 | Stueven |
| 5,233,830 | A | | 8/1993 | Takeshima et al. |
| 5,267,439 | A | | 12/1993 | Raff et al. |
| 5,270,024 | A | | 12/1993 | Kasahara et al. |
| 5,272,871 | A | | 12/1993 | Oshima et al. |
| 5,325,664 | A | | 7/1994 | Seki et al. |
| 5,331,809 | A | | 7/1994 | Takeshima et al. |
| 5,335,538 | A | | 8/1994 | Blischke et al. |
| 5,357,750 | A | | 10/1994 | Ito et al. |
| 5,359,852 | A | | 11/1994 | Curran et al. |
| 5,377,484 | A | | 1/1995 | Shimizu |
| 5,402,641 | A | | 4/1995 | Katoh et al. |
| 5,410,873 | A | | 5/1995 | Tashiro |
| 5,412,945 | A | | 5/1995 | Katoh et al. |
| 5,412,946 | A | | 5/1995 | Oshima et al. |
| 5,414,994 | A | | 5/1995 | Cullen et al. |
| 5,419,122 | A | | 5/1995 | Tabe et al. |
| 5,423,181 | A | | 6/1995 | Katoh et al. |
| 5,426,934 | A | | 6/1995 | Hunt et al. |
| 5,433,074 | A | | 7/1995 | Seto et al. |
| 5,437,153 | A | | 8/1995 | Takeshima et al. |
| 5,448,886 | A | | 9/1995 | Toyoda |
| 5,448,887 | A | | 9/1995 | Takeshima |
| 5,450,722 | A | | 9/1995 | Takeshima et al. |
| 5,452,576 | A | | 9/1995 | Hamburg et al. |
| 5,472,673 | A | | 12/1995 | Goto et al. |
| 5,473,887 | A | | 12/1995 | Takeshima et al. |
| 5,473,890 | A | | 12/1995 | Takeshima et al. |
| 5,483,795 | A | | 1/1996 | Katoh et al. |
| 5,531,972 | A | | 7/1996 | Rudy |
| 5,544,482 | A | | 8/1996 | Matsumoto et al. |
| 5,551,231 | A | | 9/1996 | Tanaka et al. |
| 5,554,269 | A | | 9/1996 | Joseph et al. |
| 5,569,848 | A | | 10/1996 | Sharp |
| 5,577,382 | A | | 11/1996 | Kihara et al. |
| 5,595,060 | A | | 1/1997 | Togai et al. |
| 5,598,703 | A | | 2/1997 | Hamburg et al. |
| 5,617,722 | A | | 4/1997 | Takaku |
| 5,622,047 | A | | 4/1997 | Yamashita et al. |
| 5,626,014 | A | | 5/1997 | Hepburn et al. |
| 5,626,117 | A | | 5/1997 | Wright et al. |
| 5,655,363 | A | | 8/1997 | Ito et al. |
| 5,657,625 | A | | 8/1997 | Koga et al. |
| 5,693,877 | A | | 12/1997 | Ohsuga et al. |
| 5,713,199 | A | | 2/1998 | Takeshima et al. |
| 5,715,679 | A | | 2/1998 | Asanuma et al. |
| 5,722,236 | A | | 3/1998 | Cullen et al. |
| 5,724,808 | A | | 3/1998 | Ito et al. |
| 5,729,971 | A | | 3/1998 | Matsuno et al. |
| 5,732,554 | A | | 3/1998 | Sasaki et al. |
| 5,735,119 | A | | 4/1998 | Asanuma et al. |
| 5,737,917 | A | | 4/1998 | Nagai |
| 5,740,669 | A | | 4/1998 | Kinugasa et al. |
| 5,743,084 | A | | 4/1998 | Hepburn |
| 5,743,086 | A | | 4/1998 | Nagai |
| 5,746,049 | A | | 5/1998 | Cullen et al. |
| 5,746,052 | A | | 5/1998 | Kinugasa et al. |
| 5,752,492 | A | | 5/1998 | Kato et al. |
| 5,771,685 | A | | 6/1998 | Hepburn |
| 5,771,686 | A | | 6/1998 | Pischinger et al. |
| 5,778,666 | A | | 7/1998 | Cullen et al. |
| 5,792,436 | A | | 8/1998 | Feeley et al. |
| 5,802,843 | A | | 9/1998 | Kurihara et al. |
| 5,803,048 | A | | 9/1998 | Yano et al. |
| 5,806,306 | A | | 9/1998 | Okamoto et al. |
| 5,813,387 | A | | 9/1998 | Minowa et al. |
| 5,831,267 | A | | 11/1998 | Jack et al. |
| 5,832,722 | A | | 11/1998 | Cullen et al. |
| 5,842,339 | A | | 12/1998 | Bush et al. |
| 5,842,340 | A | | 12/1998 | Bush et al. |
| 5,862,661 | A | | 1/1999 | Zhang et al. |
| 5,865,027 | A | | 2/1999 | Hanafusa et al. |
| 5,867,983 | A | | 2/1999 | Otani |
| 5,877,413 | A | | 3/1999 | Hamburg et al. |
| 5,894,725 | A | * | 4/1999 | Cullen et al. ..... 60/274 |
| 5,910,096 | A | | 6/1999 | Hepburn et al. |
| 5,929,320 | A | | 7/1999 | Yoo |
| 5,934,072 | A | | 8/1999 | Hirota et al. |
| 5,938,715 | A | | 8/1999 | Zhang et al. |
| 5,953,907 | A | | 9/1999 | Kato et al. |
| 5,966,930 | A | | 10/1999 | Hatano et al. |
| 5,970,707 | A | | 10/1999 | Sawada et al. |
| 5,974,788 | A | | 11/1999 | Hepburn et al. |
| 5,974,791 | A | | 11/1999 | Hirota et al. |
| 5,974,793 | A | | 11/1999 | Kinugasa et al. |
| 5,974,794 | A | | 11/1999 | Gotoh et al. |
| 5,979,161 | A | | 11/1999 | Hanafusa et al. |
| 5,979,404 | A | | 11/1999 | Minowa et al. |
| 5,983,627 | A | | 11/1999 | Asik |
| 5,992,142 | A | | 11/1999 | Pott |
| 5,996,338 | A | | 12/1999 | Hirota |
| 6,003,308 | A | | 12/1999 | Tsutsumi et al. |
| 6,012,282 | A | | 1/2000 | Kato et al. |
| 6,012,428 | A | | 1/2000 | Yano et al. |
| 6,014,859 | A | | 1/2000 | Yoshizaki et al. |
| 6,023,929 | A | | 2/2000 | Ma |
| 6,026,640 | A | | 2/2000 | Kato et al. |
| 6,058,700 | A | | 5/2000 | Yamashita et al. |
| 6,073,440 | A | | 6/2000 | Douta et al. |
| 6,079,204 | A | | 6/2000 | Sun et al. |
| 6,092,021 | A | | 7/2000 | Ehlbeck et al. |
| 6,092,369 | A | | 7/2000 | Hosogai et al. |
| 6,101,809 | A | | 8/2000 | Ishuzuka et al. |
| 6,102,019 | A | | 8/2000 | Brooks |
| 6,105,365 | A | | 8/2000 | Deeba et al. |
| 6,119,449 | A | | 9/2000 | Köhler |
| 6,128,899 | A | | 10/2000 | Oono et al. |
| 6,134,883 | A | | 10/2000 | Kato et al. |
| 6,138,453 | A | | 10/2000 | Sawada et al. |
| 6,145,302 | A | | 11/2000 | Zhang et al. |
| 6,145,305 | A | | 11/2000 | Itou et al. |
| 6,148,611 | A | | 11/2000 | Sato |
| 6,148,612 | A | | 11/2000 | Yamashita et al. |
| 6,161,378 | A | | 12/2000 | Hanaoka et al. |
| 6,161,428 | A | | 12/2000 | Esteghlal et al. |
| 6,164,064 | A | | 12/2000 | Pott |
| 6,189,523 | B1 | | 2/2001 | Weisbrod et al. |
| 6,195,987 | B1 | * | 3/2001 | Miyashita ..... 60/285 |
| 6,199,373 | B1 | | 3/2001 | Hepburn et al. |
| 6,202,406 | B1 | | 3/2001 | Griffin et al. |

| | | | | |
|---|---|---|---|---|
| 6,205,773 | B1 | 3/2001 | Suzuki | |
| 6,214,207 | B1 | 4/2001 | Miyata et al. | |
| 6,216,448 | B1 | 4/2001 | Schnaibel et al. | |
| 6,216,451 | B1 | 4/2001 | Schnaibel et al. | |
| 6,233,923 | B1 | 5/2001 | Itou et al. | |
| 6,237,330 | B1 | 5/2001 | Takahashi et al. | |
| 6,244,046 | B1 | 6/2001 | Yamashita | |
| 6,263,667 | B1 * | 7/2001 | Sawada et al. | 60/277 |

FOREIGN PATENT DOCUMENTS

| | | |
|---|---|---|
| EP | 0 444 783 A1 | 9/1991 |
| EP | 0 503 882 A1 | 9/1992 |
| EP | 0 508 389 A1 | 1/1994 |
| JP | 62-97630 | 5/1987 |
| JP | 62-117620 | 5/1987 |
| JP | 64-53042 | 3/1989 |
| JP | 2-30915 | 2/1990 |
| JP | 2-33408 | 2/1990 |
| JP | 2-207159 | 8/1990 |
| JP | 3-135147 | 6/1991 |
| JP | 5-26080 | 2/1993 |
| JP | 5-106493 | 4/1993 |
| JP | 5-106494 | 4/1993 |
| JP | 6-58139 | 3/1994 |
| JP | 6-264787 | 9/1994 |
| JP | 7-97941 | 4/1995 |
| WO | 98/27322 | 6/1998 |

* cited by examiner

METHOD AND SYSTEM FOR REDUCING LEAN-BURN VEHICLE EMISSIONS USING A DOWNSTREAM REDUCTANT SENSOR

BACKGROUND OF THE INVENTION

1. Field of the Invention

The invention relates to methods and systems for the treatment of exhaust gas generated by "lean burn" operation of an internal combustion engine which are characterized by reduced tailpipe emissions of a selected exhaust gas constituent.

2. Background Art

Generally, the operation of a vehicle's internal combustion engine produces engine exhaust that includes a variety of constituent gases, including carbon monoxide (CO), hydrocarbons (HC), and nitrogen oxides ($NO_x$). The rates at which the engine generates these constituent gases are dependent upon a variety of factors, such as engine operating speed and load, engine temperature, ignition ("spark") timing, and EGR. Moreover, such engines often generate increased levels of one or more constituent gases, such as $NO_x$, when the engine is operated in a lean-burn cycle, i.e., when engine operation includes engine operating conditions characterized by a ratio of intake air to injected fuel that is greater than the stoichiometric air-fuel ratio, for example, to achieve greater vehicle fuel economy.

In order to control these vehicle tailpipe emissions, the prior art teaches vehicle exhaust treatment systems that employ one or more three-way catalysts, also referred to as emission control devices, in an exhaust passage to store and release selected exhaust gas constituents, such as $NO_x$, depending upon engine operating conditions. For example, U.S. Pat. No. 5,437,153 teaches an emission control device which stores exhaust gas $NO_x$, when the exhaust gas is lean, and releases previously-stored $NO_x$ when the exhaust gas is either stoichiometric or "rich" of stoichiometric, i.e., when the ratio of intake air to injected fuel is at or below the stoichiometric air-fuel ratio. Such systems often employ open-loop control of device storage and release times (also respectively known as device "fill" and "purge" times) so as to maximize the benefits of increased fuel efficiency obtained through lean engine operation without concomitantly increasing tailpipe emissions as the device becomes "filled."

The timing of each purge event must be controlled so that the device does not otherwise exceed its capacity to store the selected exhaust gas constituent, because the selected constituent would then pass through the device and effect an increase in tailpipe emissions. Further, the timing of the purge event is preferably controlled to avoid the purging of only partially filled devices, due to the fuel penalty associated with the purge event's enriched air-fuel mixture. Moreover, when plural emission control devices are deployed in series, excess feedgas HC and CO during the purge event are typically initially consumed in the upstream device to release stored oxygen, whereupon the excess feedgas HC and CO ultimately "break through" the upstream device and enter the downstream device to thereby effect a both an initial release of oxygen previously stored in the downstream device and then a release of stored selected exhaust gas constituent.

The prior art has recognized that the storage capacity of a given emission control device is itself a function of many variables, including device temperature, device history, sulfation level, and the presence of any thermal damage to the device. Moreover, as the device approaches its maximum capacity, the prior art teaches that the incremental rate at which the device continues to store the selected constituent, also referred to as the instantaneous efficiency of the device, may begin to fall. Accordingly, U.S. Pat. No. 5,437,153 teaches use of a nominal $NO_x$-retaining capacity for its disclosed device which is significantly less than the actual $NO_x$-storage capacity of the device, to thereby provide the device with a perfect instantaneous $NO_x$-absorbing efficiency, that is, so that the device is able to absorb all engine-generated $NO_x$ as long as the cumulative stored $NO_x$ remains below this nominal capacity. A purge event is scheduled to rejuvenate the device whenever accumulated estimates of engine-generated $NO_x$ reach the device's nominal capacity. Unfortunately, however, the use of such a fixed nominal $NO_x$ capacity necessarily requires a larger device, because this prior art approach relies upon a partial, e.g., fifty-percent $NO_x$ fill in order to ensure retention of engine-generated $NO_x$.

The amount of the selected constituent gas that is actually stored in a given emission control device during vehicle operation depends on the concentration of the selected constituent gas in the engine feedgas, the exhaust flow rate, the ambient humidity, the device temperature, and other variables including the "poisoning" of the device with certain other constituents of the exhaust gas. For example, when an internal combustion engine is operated using a fuel containing sulfur, the prior art teaches that sulfur may be stored in the device and may correlatively cause a decrease in both the device's absolute capacity to store the selected exhaust gas constituent, and the device's instantaneous constituent-storing efficiency. When such device sulfation exceeds a critical level, the stored $SO_x$ must be "burned off" or released during a desulfation event, during which device temperatures are raised above perhaps about 650° C. in the presence of excess HC and CO. By way of example only, U.S. Pat. No. 5,746,049 teaches a device desulfation method which includes raising the device temperature to at least 650° C. by introducing a source of secondary air into the exhaust upstream of the device when operating the engine with an enriched air-fuel mixture and relying on the resulting exothermic reaction to raise the device temperature to the desired level to purge the device of $SO_x$.

Thus, it will be appreciated that both the device capacity to store the selected exhaust gas constituent, and the actual quantity of the selected constituent stored in the device, are complex functions of many variables that prior art accumulation-model-based systems do not take into account. The inventors herein have recognized a need for a method and system for controlling an internal combustion engine whose exhaust gas is received by an emission control device which can more accurately determine the amount of the selected exhaust gas constituent, such as $NO_x$, stored in an emission control device during lean engine operation and which, in response, can more closely regulate device fill and purge times to optimize tailpipe emissions.

SUMMARY OF THE INVENTION

Under the invention, a method is provided for controlling an engine operating over a range of operating conditions including those characterized by combustion of air-fuel mixtures that are both lean and rich of a stoichiometric air-fuel ratio, and wherein exhaust gas generated during engine operation is directed through an exhaust purification system including an upstream emission control device and a downstream sensor operative to generate an output signal representing a concentration of reductants, i.e., excess hydrocarbons, in the exhaust gas exiting the device. The method includes determining a first value representing a cumulative amount of a selected constituent of the engine feedgas, such as $NO_x$, generated during an engine operating condition characterized by combustion of an air-fuel mixture lean of the stoichiometric air-fuel ratio ("a lean operating condition"). The method also includes determining a second value representing an instantaneous capacity of the device to store the selected constituent, wherein the second value is determined as a function of a characteristic of the output signal generated by the reductant sensor during an engine operating condition characterized by combustion of an air-fuel mixture having an air-fuel ratio rich of the stoichiometric air-fuel ratio ("a rich air-fuel ratio"), and a predetermined reference value. The method further includes selecting an engine operating condition as a function of the first and second values.

More specifically, in a preferred embodiment in which the selected exhaust gas constituent is $NO_x$, the first value is estimated using a lookup table containing mapped values for engine-generated $NO_x$ as a function of engine operating conditions, such as instantaneous engine speed and load, air-fuel ratio, spark and EGR. The lean operating condition is discontinued, and a rich operating condition suitable for purging the device of stored feedgas $NO_x$ is scheduled, when the first value representing accumulated feedgas $NO_x$ exceeds the second value representing the instantaneous device $NO_x$-storage capacity. The second value is a previously stored value which is periodically adaptively updated based upon a comparison of the amplitude of the reductant sensor's output signal with the predetermined reference value during a subsequent device purge event. In this manner, the storage of $NO_x$ by the device and, hence, the "fill time" during which the engine is operated in a lean operating condition, is optimized.

In accordance with another feature of the invention, the method preferably includes calculating a third value representing the amount of fuel, in excess of a stoichiometric amount, which is necessary to purge the device of both stored selected exhaust gas constituent and stored oxygen, based on the first value representing accumulated exhaust gas constituent present in the engine feedgas and a previously stored fourth value representing the amount of excess fuel necessary to purge only stored oxygen from the device. The method also preferably includes determining a fifth value representing a cumulative amount of fuel, in excess of the stoichiometric amount, which has been supplied to the engine during a given rich operating condition; and discontinuing the purge event when the fifth value representing the supplied excess fuel exceeds the third value representing the necessary excess fuel to purge the device of all stored selected constituent and stored oxygen. In this manner, the invention optimizes the amount of excess fuel used to purge the device and, indirectly, the device purge time.

In accordance with another feature of the invention, the method preferably includes selecting an engine operating condition suitable for desulfating the device when the second value representing the device's instantaneous capacity to store the selected exhaust gas constituent falls below a minimum threshold value. The method further preferably includes indicating a deteriorated device if a predetermined number of device-desulfating engine operating conditions are performed without any significant increase in the second value.

In accordance with a further feature of the invention, the fourth value representing the oxygen-only excess fuel amount is periodically updated using an adaption value which is itself generated by comparing the amplitude of the reductant sensor's output signal to a threshold value during a scheduled purge.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
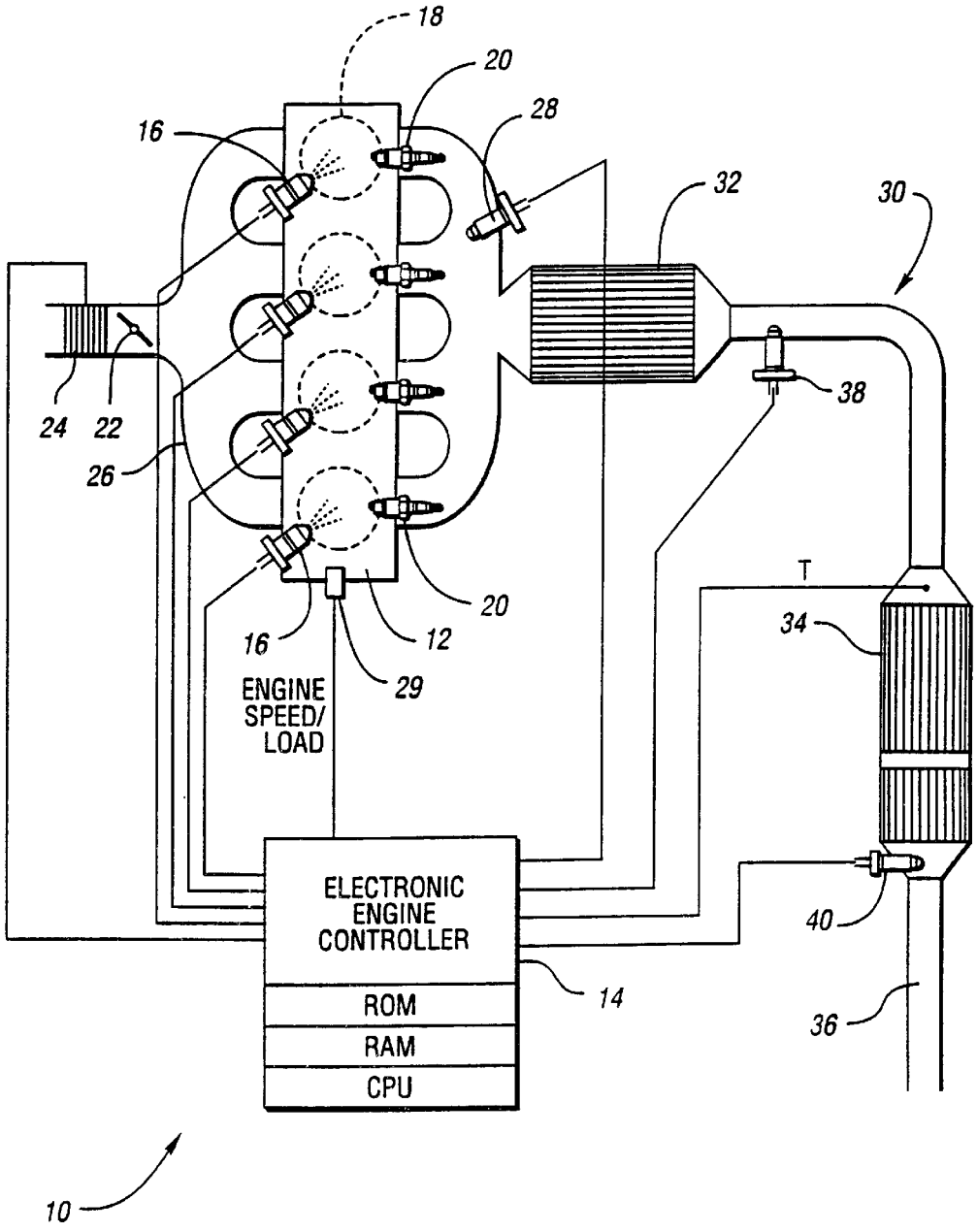
FIG. 1 is a schematic of an exemplary system for practicing the invention.

Referring to FIG. 1, an exemplary control system 10 for a four-cylinder, direct-injection, spark-ignition, gasoline-powered engine 12 for a motor vehicle includes an electronic engine controller 14 having ROM, RAM and a processor ("CPU") as indicated. The controller 14 controls the operation of a set of fuel injectors 16, each of which is positioned to inject fuel into a respective cylinder 18 of the engine 12 in precise quantities as determined by the controller 14. The controller 14 similarly controls the individual operation, i.e., timing, of the current directed through each of a set of spark plugs 20 in a known manner.

The controller 14 also controls an electronic throttle 22 that regulates the mass flow of air into the engine 12. An air mass flow sensor 24, positioned at the air intake of engine's intake manifold 26, provides a signal regarding the air mass flow resulting from positioning of the engine's throttle 22. The air flow signal from the air mass flow sensor 24 is utilized by the controller 14 to calculate an air mass value which is indicative of a mass of air flowing per unit time into the engine's induction system.

A first oxygen sensor 28 coupled to the engine's exhaust manifold detects the oxygen content of the exhaust gas generated by the engine 12 and transmits a representative output signal to the controller 14. The first oxygen sensor 28 provides feedback to the controller 14 for improved control of the air-fuel ratio of the air-fuel mixture supplied to the engine 12, particularly during operation of the engine 12 at or near the stoichiometric air-fuel ratio which, for a constructed embodiment, is about 14.65. A plurality of other sensors, including an engine speed sensor and an engine load sensor, indicated generally at 29, also generate additional signals in a known manner for use by the controller 14.

An exhaust system 30 transports exhaust gas produced from combustion of an air-fuel mixture in each cylinder 18 through an upstream catalytic emission control device 32 and, then, through a downstream catalytic emission control device 34, both of which function in a known manner to reduce the amount of engine-generated exhaust gas constituents, such as $NO_x$, that reach the vehicle tailpipe 36. A second oxygen sensor 38 is positioned in the exhaust system 30 between the upstream and downstream devices 32,34. In a constructed embodiment, the first and second oxygen sensors 28, 38 are "switching" heated exhaust gas oxygen (HEGO) sensors; however, the invention contemplates use of other suitable sensors for generating a signal representing the oxygen concentration in the exhaust manifold and exiting the upstream device 32, respectively, including but not limited to exhaust gas oxygen (EGO) type sensors, and linear-type sensors such as universal exhaust gas oxygen (UEGO) sensors.

In accordance with the invention, a reductant sensor 40 is positioned in the exhaust system 30 downstream of the downstream device 34. The reductant sensor 40 generates an output signal RECON which is representing the instantaneous concentration of reductants, i.e., excess hydrocarbons, in the exhaust gas exiting the downstream device 34.

Figure 2:
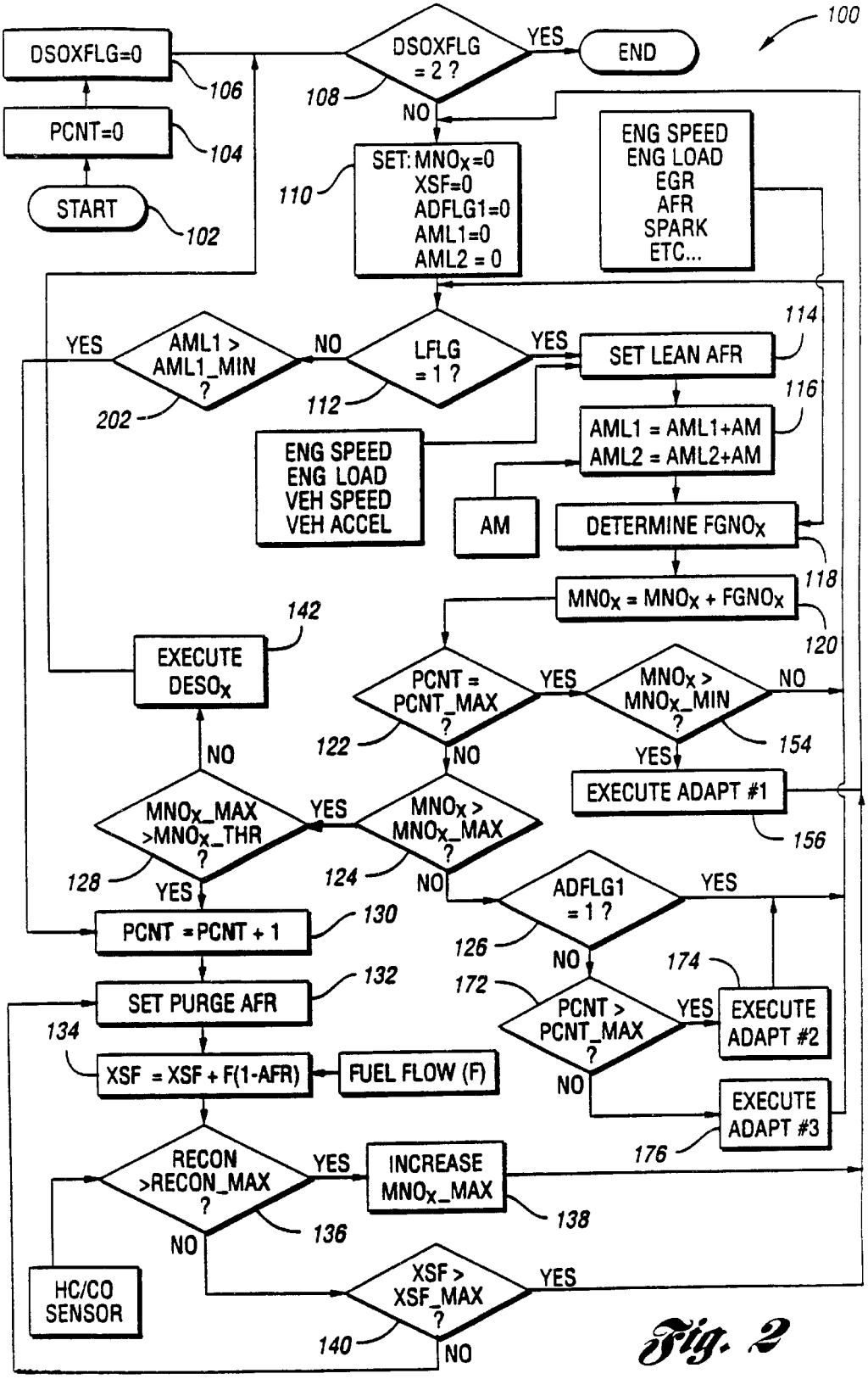
FIG. 2 is a flowchart illustrating the main control process employed by the exemplary system.

A flowchart illustrating the steps of the control process 100 employed by the exemplary system 10 is shown in FIG. 2. Upon engine startup, indicated at block 102, the controller 14 sets both a fill-purge cycle counter PCNT and a desulfation flag DSOXFLG to logical zero (blocks 104 and 106). Then, after checking the value of the desulfation flag DSOXFLG against a reference value indicative of an irrecoverably-deteriorated downstream device 34 (at block 108), the controller 14 initializes lean-burn operation, i.e., enables selection by the controller 14 of a lean engine operating condition, at block 110 by resetting the following stored values to zero: a value MNOx representing cumulative feedgas $NO_x$ generated during a given lean operating condition; a value XSF representing an amount of fuel in excess of the stoichiometric amount that has been supplied to the engine 12 during a purge event; and values AML1 and AML2 representing cumulative air mass flow into the engine's intake manifold 26 during a given lean operating condition. The controller 14 also resets (at block 110) a flag ADFLG1 indicative of the state of a plurality of adaption algorithms, the operation of each of which is described below in connection with FIGS. 4, 5, and 6.

The controller 14 then checks to see if a lean flag LFLG is set to logical "1" (block 112). If the lean flag LFLG is set to "1," indicating that lean engine operating condition has been specified, the controller 14 initiates lean engine operation (at block 114) by adjusting the fuel injectors 16 and electronic throttle 22 so as to achieve a lean air-fuel mixture having an air-fuel ratio greater than about 18 while further responding to instantaneous vehicle power requirements, as derived from sensed values for engine speed, engine load, vehicle speed and vehicle acceleration. After updating values AML1 and AML2 with the current air mass flow rate AM, as obtained from the system's air mass flow sensor 24 (at block 116, later used to define a time period within which the adaptive algorithms look for a slow response from the reductant sensor 40), the controller 14 determines a value FGNOx representing the instantaneous concentration of "feedgas" $NO_x$, i.e., the concentration of $NO_x$ in the engine exhaust as a result of the combustion of the air-fuel mixture within the engine 12 (at block 118). The value FGNOx is determined in a known manner from instantaneous engine operating conditions, which may include, without limitation, engine speed, engine load, EGR, air-fuel ratio, and spark. By way of example only, in a preferred embodiment, the controller 14 retrieves a stored estimate for instantaneously feedgas $NO_x$ concentration from a lookup table stored in ROM, originally obtained from engine mapping data.

At block 120 of FIG. 2, the controller 14 updates the value MNOx representing the cumulative amount of feedgas $NO_x$ which has been generated by the engine 12 during the lean operating condition. The controller 14 compares the current value PCNT for the fill-purge cycle counter to a reference value PCNT_MAX (at block 122). The purpose of the fill-purge cycle counter is to enable the controller 14 to periodically break-out of a lean operating condition with only a partially-filled downstream device 34, in order to adaptively update a previously stored maximum threshold value MNOx_MAX representing the instantaneous $NO_x$-storage capacity of the downstream device 34 (as described more fully below).

If the counter PCNT does not equal the reference value PCNT_MAX, the controller 14 compares the cumulative feedgas $NO_x$ value MNOx to the maximum threshold value MNOx_MAX (at block 124) If the cumulative feedgas $NO_x$ value MNOx is not greater than the maximum threshold value MNOx_MAX, the controller 14 determines (at block 126) whether an adaption flag ADFLG1 is set to logical "1." If the adaption flag ADFLG1 is set to logical "1," the controller 14 continues to enable the selection of a lean engine operating condition, by returning to block 112 as illustrated in FIG. 2. If the adaption flag ADFLG is not set to logical "1," the controller 14 proceeds to step 172 and then executes either of two adaption algorithms 174,176 based upon the current value of the purge cycle counter PCNT, as discussed below in connection with FIGS. 5 and 6.

Figure 3:
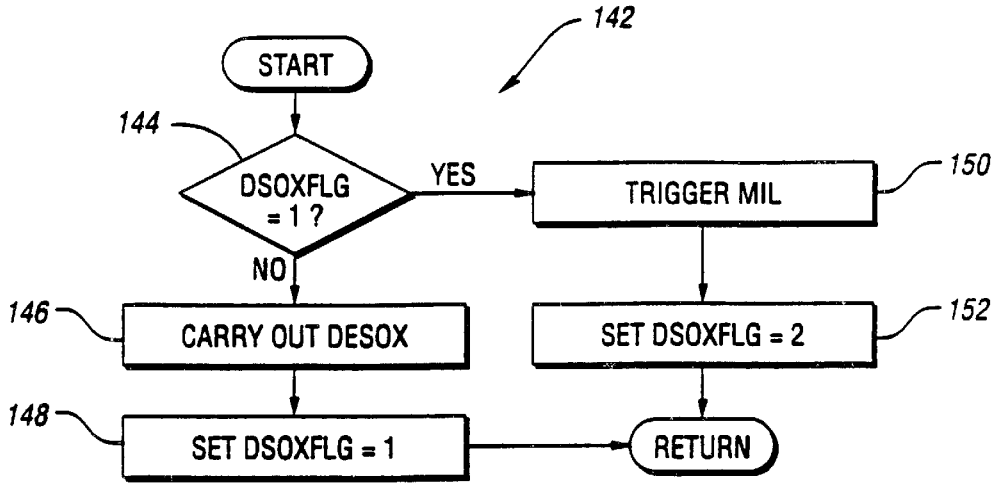
FIGS. 3–5 are flowcharts illustrating the control process for three adaptive algorithms for updating previously stored values utilized by the exemplary system.

If, at block 124, the controller 14 determines the cumulative feedgas $NO_x$ value MNOx is greater than the maximum threshold value MNOx_MAX, the controller 14 discontinues the lean operating condition and then compares the cumulative feedgas $NO_x$ value MNOx to a first minimum threshold value MNOx_THR (at block 128). The first minimum threshold value MNOx_THR represents a minimum acceptable level of $NO_x$ storage and, hence, a failure of the cumulative feedgas $NO_x$ value MNOx to exceed the first minimum threshold value MNOx_THR is indicative of a threshold level of device deterioration requiring a response, such as the scheduling of a desulfation event (the control process for which is generally illustrated in FIG. 3, described below). If the cumulative feedgas $NO_x$ value MNOx is greater than the first minimum threshold value MNOx_THR (at block 128), the controller 14 schedules a downstream device purge event at the first opportunity.

When initiating a purge event, the controller 14 first updates the value PCNT representing the number of downstream device fill-purge cycles since the last downstream device desulfation event (at block 130). The controller 14 then operates the fuel injectors 16 and the electronic throttle 22 so as to switch the air-fuel ratio of the air-fuel mixture supplied to one or more cylinders 18 to a selected purge air-fuel ratio (at block 132). The controller 14 then updates the value XSF representing the amount by which the fuel flow F supplied during the purge event exceeds that which is required for stoichiometric engine operation (at block 134).

The controller 14 then compares the output signal RECON generated by the reductant sensor 40 to a predetermined maximum threshold value RECON_MAX (at block 136). As noted above, the sensor output signal RECON is representative of the instantaneous concentration of reductants, e.g., excess CO, $H_2$ and HC, in the exhaust gas exiting the downstream device 34. If the sensor output signal RECON is greater than the maximum threshold value RECON_MAX, indicating an excess amount of hydrocarbons in the exhaust gas exiting the downstream device 34, the downstream device 34 must already be substantially purged of both stored $NO_x$ and stored oxygen, thereby further indicating that the previously stored maximum threshold value MNOx_MAX is too low. Accordingly, the controller 14 increases the stored maximum threshold value MNOx_MAX by a predetermined increment (at block 138) and reenables lean engine operation (by looping back to block 110 of FIG. 2).

If the controller 14 determines (at block 136) that the reductant sensor output signal RECON is not greater than the maximum threshold value RECON_MAX, the controller 14 compares (at block 140) the value XSF representing the supplied excess purge fuel to a calculated reference value XSF_MAX representing the amount of purge fuel, in excess of the stoichiometric amount, necessary to release both stored $NO_x$ and stored oxygen from the downstream device 34. More specifically, the excess fuel reference value $XSF_x$ MAX is directly proportional to the quantity of $NO_x$ previously calculated to have been stored in the downstream device 34 (represented by the value MNOx achieved in the immediately preceding fill)and is determined according to the following expression:

$$XSF_MAX=K\times MNOx\times EFF_DES+XSF_OSC,$$

where:

K is a proportionality constant between the quantity of $NO_x$ stored and the amount of excess fuel;

MNOx is a value for cumulative feedgas $NO_x$ generated in an immediately preceding lean operating condition;

$EFF_{13}$ DES is a desired device absorption efficiency, for example, eighty to ninety percent of the $NO_x$ passing through the downstream device 34; and XSF_OSC is a previously calculated value representing the quantity of excess fuel required to release oxygen stored within the downstream device 34, as discussed further below.

If the supplied excess fuel value XSF does not exceed the calculated excess fuel reference value XSF_MAX (as determined at block 140 of FIG. 2), the controller 14 loops back (to block 132) to continue the purge event. If, however, the supplied excess fuel value XSF exceeds the calculated excess fuel reference value XSF_MAX, the downstream device purge event is deemed to have been completed, and the controller 14 reenables lean engine operation (by looping back to block 110).

As noted above, after the controller 14 determines that lean operating condition should be discontinued at block 124 of FIG. 2, if the controller 14 also determines that the cumulative feedgas $NO_x$ value MNOx is greater than the first minimum threshold value MNOx_THR representing the minimum acceptable level of $NO_x$ storage (the latter being determined at block 128), the controller 14 schedules a purge event. However, if the controller 14 determines (at block 128) that the cumulative feedgas $NO_x$ value MNOx is not greater than the first minimum threshold value MNOx_THR after discontinuing a lean operating condition, the controller 14 schedules a downstream device desulfating event, as indicated at block 142 of FIG. 2.

The control process 142 for a desulfation event is generally illustrated in FIG. 3. Specifically, the controller 14 initially checks the value of a desulfation flag DSOXFLG (at block 144). If DSOXFLG is equal to 1, indicating that the subject desulfation event is one of several, immediately-successive downstream device desulfating events (suggesting that the downstream device 34 has irrevocably deteriorated and, hence, needs servicing). The controller 14 triggers an MIL light in step 150 and sets DSOXFLG to 2 in step 152. If the desulfation flag DSOXFLG is set to logical zero, the controller 14 initiates a desulfation event in step 146, during which the controller 14 enriches the air-fuel mixture supplied to each engine cylinder 18 at a time when the controller 14 has otherwise operated to raise the temperature T of the downstream device 34 above a minimum desulfating temperature of perhaps about 62520 C. Upon completion of the desulfation event, the controller 14 sets the desulfation flag DSOXPLG to logical "1" in step 148. The controller 14 then operates the fuel injectors 16 and the electronic throttle 22 to return engine operation to either a near-stoichiometric operating condition or, preferably, a lean operating condition to achieve greater vehicle fuel economy.

As noted above, if the controller 14 determines, during a lean operating condition, that the counter PCNT equals a reference value PCNT_MAX (at block 122), the controller 14 compares the cumulative feedgas $NO_x$ value MNOx to a second minimum threshold value MNOx_MIN (at block 154) which is typically substantially less than the first minimum threshold value MNOx_THR and, most preferably, is selected such that stored oxygen predominates over stored $NO_x$ within the downstream device 34. If the cumulative feedgas $NO_x$ value MNOx is not greater than the second minimum threshold value MNOx_MIN (as determined at block 154), the downstream device 34 has not yet been partially filled to the level represented by the second minimum threshold value MNOx_MIN, which fill level is required to adaptively update the previously stored value XSF_OSC representing the quantity of excess fuel required to release oxygen stored within the downstream device 34, and the controller 14 loops back to block 112 for further lean engine operation, if desired (as indicated by flag LFLG being equal to logical "1").

Figure 4:
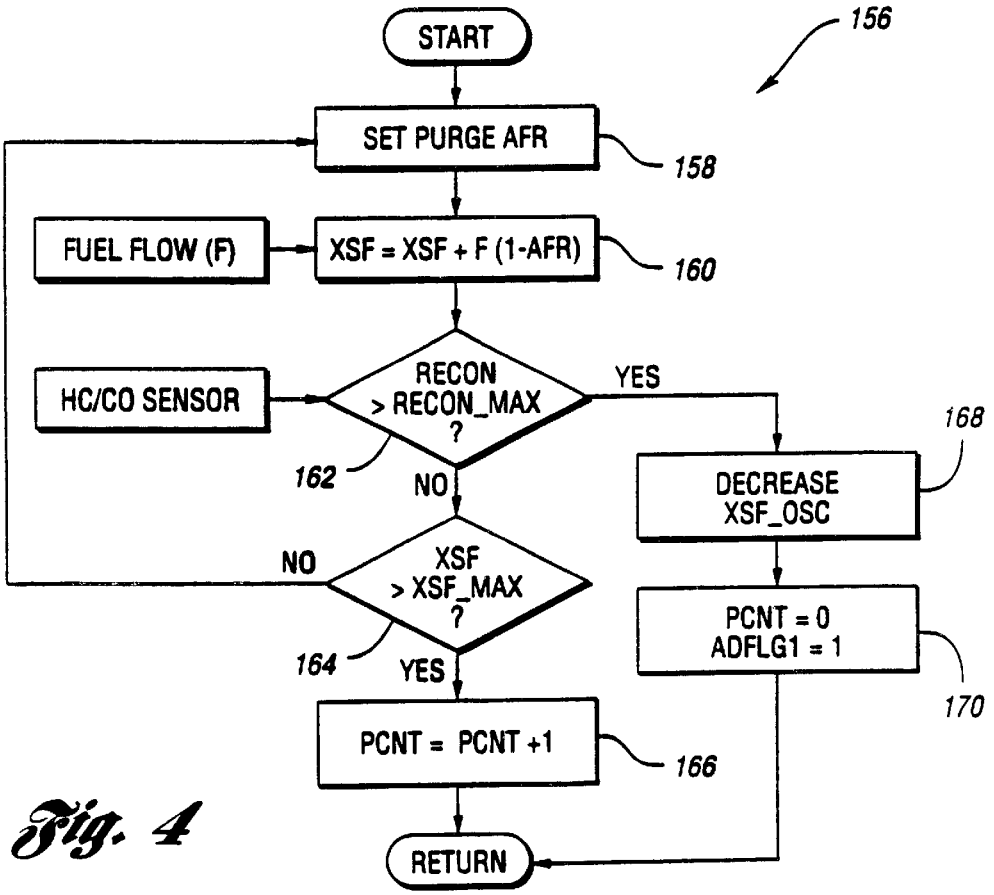

If the cumulative feedgas $NO_x$ value MNOx is greater than the second minimum threshold value MNOx_MIN (as determined at block 154 of FIG. 2), the controller 14 executes a first adaptive algorithm 156, whose control process is illustrated in greater detail in FIG. 4. Specifically, the controller 14 immediately discontinues the lean operating condition and schedules a downstream device purge event, in the manner described above. During the immediately following purge event, in which the air-fuel ratio is set to the selected purge air-fuel ratio (at block 158) and the fuel flow F is summed to obtain the desired excess fuel value XSF (at block 160), the controller 14 again compares the sensor output signal RECON with the maximum threshold value RECON_MAX (at block 162). If the controller 14 determines that the sensor output signal RECON is greater than the maximum threshold value RECON_MAX, thereby indicating an excess amount of hydrocarbons in the exhaust gas exiting the downstream device 34, the downstream device 34 is deemed to already be substantially purged of both stored $NO_x$ and stored oxygen. And, since oxygen storage predominates when the downstream device 34 is filled to the level represented by the second minimum threshold value MNOx_MIN, the previously stored value XSF_OSC representing the quantity of excess fuel required to release stored oxygen is likely too high. Accordingly, the controller 14 immediately discontinues the purge event and further decreases the stored value XSF_OSC by a predetermined increment (at block 168). The controller 14 also resets both the counter PCNT and the adaption flag ADFLG to logical-zero (at block 170).

If the controller 14 otherwise determined, at block 162, that the sensor output signal RECON does not exceed the maximum threshold value RECON_MAX, the controller 14 compares the excess fuel value XSF to the excess fuel reference value XSF_MAX (at block 164). When the excess fuel value XSF is greater than the excess fuel reference value XSF_MAX, the downstream device 34 is deemed to have been substantially purged of both stored $NO_x$ and stored oxygen. The purge cycle counter PCNT is then incremented (at block 166) and the controller 14 returns to the main control process 100 of FIG. 2.

Figure 5:
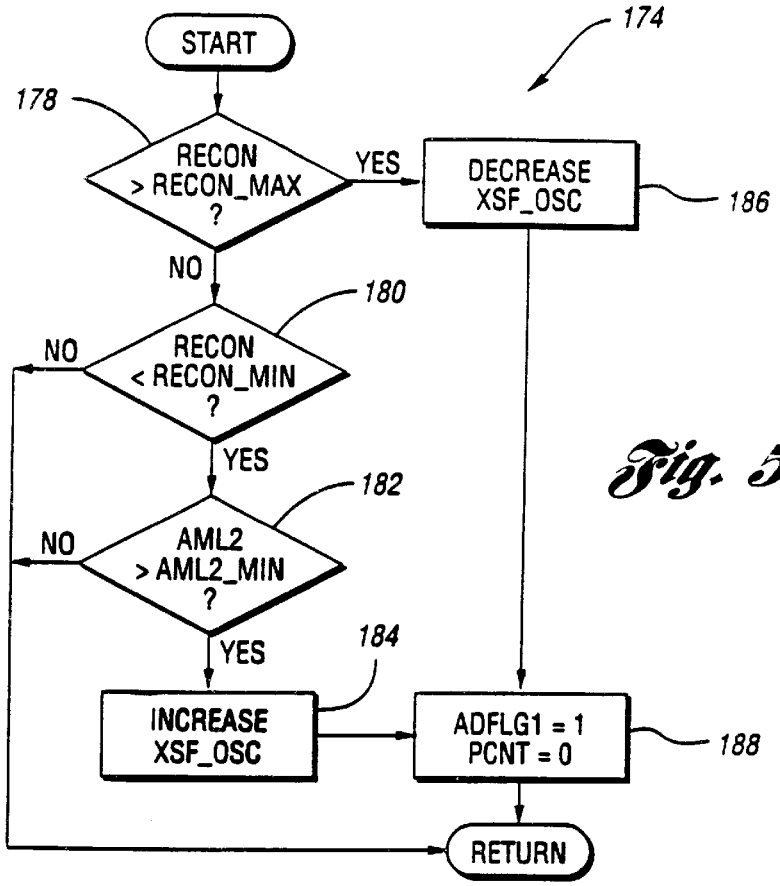

Returning to the decision made by the controller 14 at block 126 of FIG. 2, if the controller 14 determines that the adaption flag ADFLG is not set to logical "1," the controller 14 then determines in step 172 whether the purge cycle counter PCNT is greater than the reference value PCNT_MAX. If the answer to step 172 is yes, i.e., the counter PCNT exceeds the reference value PCNT_MAX, the controller 14 executes the second adaption algorithm 174 whose control process is generally illustrated in FIG. 5. Otherwise, if the answer to step 172 is no, the controller 14 executes the third adaption algorithm 176 whose control process is generally illustrated in FIG. 6.

As seen in FIG. 5, in the second adaption algorithm 174, if the controller 14 determines at block 178 that the sensor output signal RECON is not greater than the maximum reference value RECON_MAX, indicating that the downstream device 34 has not been substantially purged both of stored $NO_x$ and of stored oxygen, the controller 14 then confirms that both the sensor output signal RECON is less than a minimum reference value RECON_MIN and that the second cumulative air mass flow measure AML2 is greater than a minimum threshold AML2_MIN at blocks 180 and 182, respectively (the latter serving to ensure that there has not been an inordinate delay between a change in the air-fuel mixture delivered to each cylinder 18 and the point in time when the resulting exhaust reaches the downstream reductant sensor 40). If so, the controller 14 immediately discontinues the purge event and increases the stored value XSF_OSC by a predetermined increment (at block 184). If either condition of blocks 180 and 182 is not met, however, the controller 14 immediately loops back to the main control process 100.

Continuing with FIG. 5, if the controller 14 otherwise determines at block 178 that the sensor output signal RECON is greater than the maximum reference value RECON_MAX, indicating that the downstream device 34 has been substantially purged both of stored $NO_x$ and of stored oxygen, the controller 14 immediately discontinues the purge event and further decreases the stored value XSF_OSC by a predetermined increment (at block 186). Then, after the controller 14 has either increased or decreased the stored value XSF_OSC at blocks 184 or 186, the controller 14 sets the adaption flag ADFLG to logical "1," resets the counter PCNT to zero (both at block 188), and returns to the main control process 100.

Figure 6:
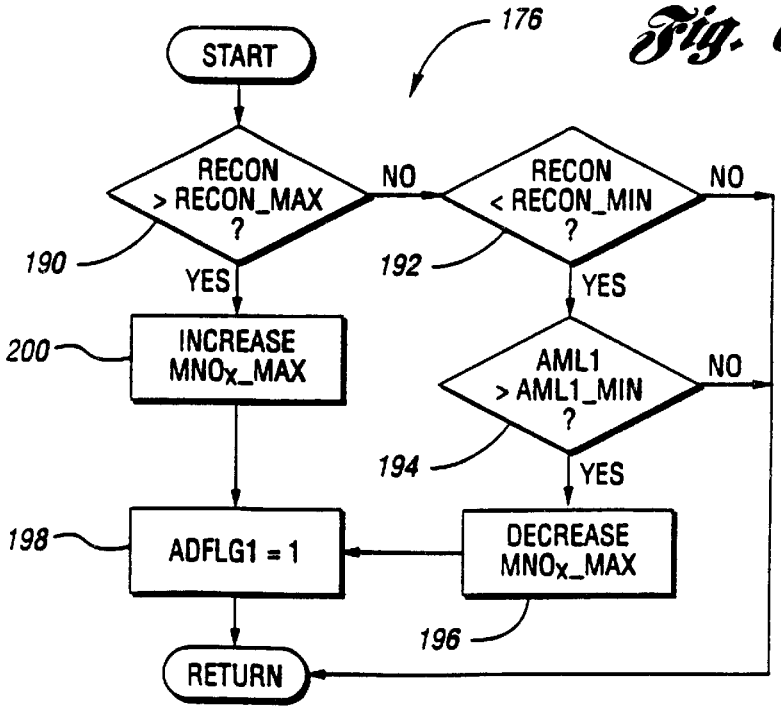

Referring to the third adaption algorithm 176 illustrated in FIG. 6, if the controller 14 determines at block 190 that the sensor output signal RECON is not greater than the maximum reference value RECON_MAX, indicating that the downstream device 34 has not been substantially purged both of stored $NO_x$ and of stored oxygen, the controller 14 then confirms that both the sensor output signal RECON is less than a minimum reference value RECON_MIN and that the first cumulative air mass flow measure AMI1 is greater than a minimum threshold AML1_MIN at blocks 192 and 194, respectively (the latter similarly serving to ensure that there has not been an inordinate delay between a change in the air-fuel mixture delivered to each cylinder 18 and the point in time when the resulting exhaust reaches the downstream reductant sensor 40). If so, the actual device efficiency may be assumed to be less than the is a desired device absorption efficiency value EFF_DES used in the calculation of the excess fuel reference value XSF_MAX, and the controller 14 immediately discontinues the purge event and decreases the stored maximum threshold value MNOx_MAX by a predetermined increment (at block 196). If either condition of blocks 192 and 194 is not met, however, the controller 14 immediately loops back to the main control process 100.

Continuing with FIG. 6, if the controller 14 otherwise determines at block 190 that the sensor output signal RECON is greater than the maximum reference value RECON_MAX, indicating that the downstream device 34 has been substantially purged both of stored $NO_x$ and of stored oxygen, the controller 14 immediately discontinues the purge event and further increases the stored maximum threshold value MNOx_MAX value by a predetermined increment (at block 200). Then, after the controller 14 has either increased or decreased the stored value XSF_OSC at blocks 184 or 186, the controller 14 sets the adaption flag ADFLG to logical "1" (at block 198), and returns to the main control process 100.

Finally, returning to the main control process 100 illustrated in FIG. 2, if the controller 14 determines, at block 112, that lean operating flag LFLG is not set to logical "1," the controller 14 compares the first cumulative air mass flow value AML1 to a minimum threshold value AML1_MIN (at block 202) representing a minimum engine operating time. If the first cumulative air mass flow value AML1 exceeds the threshold value AML1_MIN, a purge event is immediately scheduled to ensure maximum device operating efficiency.

While an exemplary embodiment of the invention has been illustrated and described, it is not intended that the disclosed embodiment illustrate and describe all possible forms of the invention. Rather, the words used in the specification are words of description rather than limitation, and it is understood that various changes may be made without departing from the spirit and scope of the invention.

What is claimed:

1. A method for controlling an engine operating over a range of operating conditions characterized by combustion of air-fuel mixtures that are lean and rich of a stoichiometric air-fuel ratio to generate exhaust gas, wherein the exhaust gas is directed through an upstream emission control device and a downstream sensor that generates an output signal representing a concentration of reductants in the exhaust gas exiting the device, the method comprising:

determining, during a lean operating condition characterized by combustion of an air-fuel mixture having a lean air-fuel ratio, a first value representing a cumulative amount of a selected constituent of the exhaust gas being generated by the engine;

comparing the first value to a previously stored second value representing an instantaneous capacity of the device to store the selected constituent, wherein the second value is periodically updated as a function of an amplitude of the output signal generated by the reductant sensor and at least one predetermined reference value;

and selecting an engine operating condition as a function of the first and second values.

2. The method of claim 1, wherein determining the first value includes estimating an instantaneous amount of the selected constituent generated by the engine as a function of at least one of the group consisting of an engine speed, an engine load, an ignition timing, an air-fuel ratio, and EGR.

3. The method of claim 1, wherein periodically updating the second value includes:

comparing, during a rich operating condition characterized by combustion of an air-fuel mixture having a rich air-fuel ratio, the output signal with a predetermined maximum reference value; and increasing the second value by a predetermined amount based upon the comparison of the output signal with the predetermined maximum reference value.

4. The method of claim 3, wherein increasing includes increasing the second value by the predetermined amount when an amplitude of the output signal exceeds the predetermined maximum reference value.

5. The method of claim 4, wherein the selecting step includes discontinuing the rich operating condition when the amplitude of the output signal exceeds the predetermined maximum reference value.

6. The method of claim 1, wherein selecting includes comparing, during a lean operating condition characterized by combustion of an air-fuel mixture having a lean air-fuel ratio, the first value to the second value; and discontinuing the lean operating condition when the first value exceeds the second value.

7. The method of claim 1, wherein selecting includes:

calculating, during a rich operating condition characterized by combustion of an air-fuel mixture having a rich air-fuel ratio, a third value representing an amount of fuel, in excess of a stoichiometric amount of fuel sufficient to provide an air-fuel mixture having a stoichiometric air-fuel ratio, required to release stored selected constituent and stored oxygen from the device as a function of the second value and a previously stored fourth value representing an amount of excess fuel required to release only stored oxygen from the device;

determining a fifth value representing a cumulative amount of fuel, in excess of the stoichiometric amount, supplied to the engine during the rich operating condition; and discontinuing the rich operating condition when the fifth value exceeds the third value.

8. The method of claim 7, wherein determining the fifth value includes:

comparing, during a lean operating condition characterized by combustion of an air-fuel mixture having a lean air-fuel ratio, the output signal to the predetermined maximum reference value; and increasing or decreasing the fifth value by a predetermined amount based upon the comparison of the output signal with the first predetermined reference value.

9. The method of claim 8, wherein increasing the fifth value includes increasing the fifth value by the predetermined amount when an amplitude of the output signal exceeds the predetermined maximum reference value.

10. The method of claim 8, wherein decreasing the fifth value includes decreasing the fifth value by the predetermined amount when an amplitude of the output signal is less than a predetermined minimum reference value.

11. The method of claim 7, wherein determining the fifth value includes:

comparing, during a rich operating condition characterized by combustion of an air-fuel mixture having a rich air-fuel ratio, the output signal to a set of reference values including the predetermined maximum reference value; and if the fifth value does not exceed the third value, decreasing the fifth value by the predetermined amount based upon the comparison of the output signal with the set of reference values.

12. The method of claim 10, wherein decreasing the fifth value includes decreasing the fifth value by the predetermined amount when an amplitude of the output signal is less than the predetermined maximum reference value.

13. The method of claim 1, wherein selecting includes:

comparing, during a lean operating condition characterized by combustion of an air-fuel mixture having a lean air-fuel ratio, the second value to a minimum device capacity value; and selecting a device-desulfating engine operating condition when the first value exceeds the second value, and the second value falls below the minimum device capacity value.

14. The method of claim 13, further including indicating device deterioration if a predetermined number of device-desulfating engine operating conditions are performed without a significant increase in a maximum value for the first value.

15. A system for controlling an engine, wherein the engine operates over a range of operating conditions characterized by combustion of air-fuel mixtures that are lean and rich of a stoichiometric air-fuel ratio to generate exhaust gas, wherein the exhaust gas is directed through an upstream emission control device and a downstream sensor that generates an output signal representing a concentration of reductants in the exhaust gas exiting the device, the system comprising:

a controller including a microprocessor arranged to determine, during a lean operating condition characterized by combustion of an air-fuel mixture having a lean air-fuel ratio, a first value representing a cumulative amount of a selected constituent of the exhaust gas being generated by the engine, and wherein the controller is further arranged to compare the first value to a previously stored second value representing an instantaneous capacity of the device to store the selected constituent, wherein the second value is periodically updated as a function of an amplitude of the output signal generated by the reductant sensor and at least one predetermined reference value; and to select an engine operating condition as a function of the first and second values.

16. The system of claim 15, wherein the controller is further arranged to compare, during a rich operating condition characterized by combustion of an air-fuel mixture having a rich air-fuel ratio, the output signal with a predetermined maximum reference value, and to increase the second value by a predetermined amount when an amplitude of the output signal exceeds the predetermined maximum reference value.

17. The system of claim 16, wherein the controller is further arranged to discontinue the rich operating condition when the amplitude of the output signal exceeds the predetermined maximum reference value.

18. The system of claim 16, wherein the controller is further arranged to calculate, during the rich operating condition, a third value representing an amount of fuel, in excess of a stoichiometric amount of fuel sufficient to provide an air-fuel mixture having a stoichiometric air-fuel ratio, required to release stored selected constituent and stored oxygen from the device as a function of the second value and a previously stored fourth value representing an amount of excess fuel required to release only stored oxygen from the device, and to determine a fifth value representing a cumulative amount of fuel, in excess of the stoichiometric amount, supplied to the engine during the rich operating condition; and wherein the controller is further arranged to discontinue the rich operating condition when the fifth value exceeds the third value.

19. The system of claim 18, wherein the controller is further arranged to compare, during a lean operating condition characterized by combustion of an air-fuel mixture having a lean air-fuel ratio, the output signal to the predetermined maximum reference value, and to increase or decrease the fifth value by a predetermined amount based upon the comparison of the output signal with the first predetermined reference value.

20. The system of claim 18, wherein the controller is further arranged to compare, during the rich operating condition, the output signal to a set of reference values including the predetermined maximum reference value; and if the fifth value does not exceed the third value, decreasing the fifth value by the predetermined amount based upon the comparison of the output signal with the set of reference values.

21. The system of claim 15, wherein the controller is further arranged to compare, during a lean operating condition characterized by combustion of an air-fuel mixture having a lean air-fuel ratio, the first value to the second value, and to discontinue the lean operating condition when the first value exceeds the second value.

22. The system of claim 15, wherein the controller is further arranged to indicate device deterioration if a predetermined number of device-desulfating engine operating conditions are performed without a significant increase in a maximum value for the first value.

* * * * *